United States Patent [19]

Filipovitch et al.

[11] 4,449,566

[45] May 22, 1984

[54] FOUNDRY SAND RECLAMATION

[75] Inventors: Anthony J. Filipovitch, Dearborn; Julius M. Bleuenstein, Rockwood, both of Mich.

[73] Assignee: Ford Motor Company, Dearborn, Mich.

[21] Appl. No.: 28,134

[22] Filed: Apr. 9, 1979

[51] Int. Cl.[3] ..... B22C 5/00

[52] U.S. Cl. ..... 164/5

[58] Field of Search ..... 164/5; 241/24, 25, 27, 241/DIG. 10; 134/2, 17, 18, 19, 25 R

[56] References Cited

U.S. PATENT DOCUMENTS

| | | | |
|---|---|---|---|
| 2,813,318 | 11/1957 | Horth | 164/5 X |
| 3,230,635 | 1/1966 | Dietert | 164/5 X |
| 4,144,088 | 3/1979 | Adams | 164/5 X |

FOREIGN PATENT DOCUMENTS

| | | | |
|---|---|---|---|
| 1806842 | 5/1970 | Fed. Rep. of Germany . | |
| 2554405 | 6/1976 | Fed. Rep. of Germany | 164/5 |

OTHER PUBLICATIONS

Report on Sand Reclamation Investigation of American Steel Foundries, vol. 30, AFA Transactions 1923, pp. 743–761.

Reclaim Ferrous Foundry Sand, Jeter, E. C., American Foundryman, Feb. 1949, pp. 40–44.

Foundry Sand Reclamation Techniques, Smith, K. J., Foundry M & T, Nov. 1976, pp. 48–52.

Sand Reclamation, Past, Present, Future, Den Breejen, A. C. , AFS Transactions, vol. 82, 1974, pp. 7–14.

Molding Methods and Materials, 5th ed., American Foundrymen's Society, 1962, pp. 211–216.

*Primary Examiner*—Kuang Y. Lin

*Attorney, Agent, or Firm*—Joseph W. Malleck; Olin B. Johnson

[57] ABSTRACT

A dry method of conditioning spent foundry sand is disclosed. After having sized the sand and removal of tramp metallic elements, the sand is subjected to a sequence of squeezing under a high-stress low kinetic energy system for a period of 5–30 minutes, and then propelled against a target with high-kenitic energy in the presence of a suction for several minutes. This sequence can be preferably repeated to increase the quality of the resulting product which should have 0.1% or less of fine particles, a pH of 6–9, a clay content and organic combustible content of substantially zero. The reclaimed sand will exhibit a density of at least 100 grams/biscuit when compacted for core making or molding.

8 Claims, 4 Drawing Figures

FOUNDRY SAND RECLAMATION

BACKGROUND OF THE INVENTION

Confusion has existed as to what sand reclamation means, particularly in the early years of sand conditioning. Some foundrymen deemed reuse of old used sand a form of reclamation, while others deemed rejuvenation of old sand heaps with new sand and clay additions to be reclamation. Yet others felt that the mechanical reconditioning of an old sand mass by merely removing lumps, foreign metal and ultra fine particles, should be accepted as reclamation. Only a few in the earlier years conceived reclamation to be a matter of treating individual grains to restore them to a physical state approximating that of new sand grains. It is this latter meaning that applies in this disclosure because it has become the accepted meaning of sand reclamation in modern foundry technology. One recent twist may be added to this definition: it should include the reclamation of new sand which is below ground mined; although it is new sand, it contains quantities of impurities which must be removed if they are to be equivalent to bank sand or above ground mined sand.

Sand reclamation has been slow in being accepted by the foundry for commercial implementation. There has existed for some time an industrywide attitude that reclamation only adds to the complexities of selecting, preparing, testing and controlling the sand to be used to make cores or molds. The average foundryman is adverse to changing established procedures that have taken years of trial and error to arrive at the right binder chemistry, shape, flowability, and grain size that will give the right ramming pressure and carrying properties. Reclaim sand is believed, in accordance with this attitude, to introduce additional unknown variable and technical considerations that trade off new problems for solving the immediate problem of conserving sand. This invention is designed to provide a reclaim sand product that does not trade off new problems; the reclaim sand is defined by a number of parameters that make it substantially the same as new bank sand and in many cases better.

The primary consideration that has guided the course of sand reclamation development heretofore has been the technical success of the particular process in terms of the quality of the reclaim sand; today the important considerations are (a) the cost of energy employed in the process, (b) the amount of land that is required to support the processing equipment, (c) governmental regulations of waste disposal, and (d) density or chemical variability of the reclaim sand preventing sand bonding for core making.

The progression of the technology includes reuse of old sand, rejuvenation by dilution, reconditioning, wet methods, thermal methods, dry methods, and combination of the latter. With this in mind, a review of the fundamental concepts for each of these categories shall follow:

Reuse of Old Sand

Any initial period of success which is enjoyed by reusing old sand with no further reconditioning or reclamation, is followed by a progressive deterioration in sand workability and casting finish with the passing of time. Eventually, savings effected by reusing the old sand becomes questionable as increasing losses are suffered in production and cleaning operations. The progressive deterioration results from the cumulative effects of physical changes (a) within a sand mass as a whole, and (b) upon the surfaces of individual sand grains. In preparing foundry sand mixtures, individual grains are provided with coatings of bond. Through successive cycles of a system, such coatings become thicker with each added layer of fresh bond. Eventually, and as shown in FIG. 2, most grains become encased in "shells" 13 and 14 of old bond; the "shells" tend to become hard and brittle with the passing of time and repeated subjection to high temperatures. The continuous artificial enlargement of individual grains creates a sand mass with an increasingly greater number of grains being retained on the coarser sieves of a distribution analysis. At the same time, under mechanical and thermal stresses, the embrittled coatings on some grains crack and separate to produce an increase in fine particles. Thus, over a period of time, a progressive change in the mass grain distribution results in more and more fines becoming dispersed throughout a matrix containing more and more oversized grains. In addition, compound grains may result when a number of small grains become cemented together to create large irregular shapes possessing uncertain physical stability in the presence of mechanical and thermal forces. This change in grain distribution produces an increase in total surface area and forces the foundrymen to increase strength and moisture levels with each additional cycle through the system. Eventually this gets out of control.

An important physical change with respect to individual sand grains and their contribution to mass deterioration is the creation of "pickled" sand grains; grains which have surfaces covered with wart-like projections 11 because of small particles 12 being embedded in the old bond coatings 13 and 14. These projections interfere with the movement of the sand grains and the projections decrease mass flowability and response to ramming energy. Increasing ramming energy or pressure also results in problems because more particles with their shells are broken increasing the fines which also causes the sand mass to suffer.

Rejuvenation by Dilution

It was hoped, in the earlier years, that used sand from an old system could be kept within control if it received daily additions of fresh sand. The incoming fresh sand would serve to constantly dilute the system thus offsetting the influence of old sand and hopefully to offset the accumulation effects of various physical changes of the used sand. However, this has not proved successful because of the stringent requirements that are placed upon sand selection and physical condition of the sand for core room use. But more importantly, dilution requires a ton of used sand to be removed for each ton of fresh sand added to keep the system at more or less constant tonnage level. This creates considerable disposal problems and comes in direct conflict with governmental regulations which inhibit the dumping and burying of used sand carrying various types of chemicals.

Reconditioning

Reconditioning merely contemplates that the used sand will be passed over magnetic pulleys, through lump breakers and screens, and then aerated to remove fines. Unfortunately, reconditioning treats a sand mass as a whole and fails to materially affect the physical state of individual grains. Nothing is done to remove the old bond coatings on individual grains and the breaking up of compound grain formations. Thus, reconditioned sand cannot perfrom similar to new sand because nothing is done to restore the surface condition of the old grains.

Wet methods

Wet reclamation installations have failed to meet expectations in the past because their designers assumed the solvent action of water to be sufficient to remove "shells" from old sand grains. In actuality, it is not enough to just wash an old sand mass. The individual sand grains must be subjected to an intense wet-scrubbing action. Such an action can be obtained by pumping or mechanically agitating a properly proportioned mixture of used sand in water. Peak efficiency in wet scrubbing is never obtained because the maximum impact in abrasion between colliding sand grains cannot be fully obtained. The "shells" possess durability and wet scrubbing produces a continuous abrasion that smoothes and reduces the thickness of old bond coating, but never entirely removes all of the shells from the sand grains. Only by extremely lengthy scrubbing cycles can increased shell coatings be removed.

Wet methods are particularly useful in removing the clay content of used sand, which becomes a chammote upon being used under heat. This dead or used clay content of the sand is water soluble. However, the greatest drawback of wet reclamation, and probably its principal reason for rejection, is that it requires a wet separation step to remove the debris and fines from the water solution. Wet separation requires huge settling reservoirs or ponds demanding extensive land usage which must be devoted to this technique of settling. Because of this the cost of land requirements for supporting such a system are prohibitive. Due to the solubility of clay in water, no satisfactory method has been devised to separate such Bentonite clays from the water solution except by settling.

Thermal Methods

Thermal or ignition methods are most helpful when attempting to reclaim sands bonded only with carbonaceous materials such as cereals, core oils, and resins. They have not been successful when applied to mixtures of core and molding sands containing varying amounts of clay binders. Various types of apparatus have been employed to carry out the thermal methods of treatment, including a roasting furnace, a fluid bed furnace and a rotary kiln. The thermal calcine system subjects the sand to temperatures in the range of 1200°–1500° in the presence of excess oxygen, thereby hopefully removing carbonaceous costings and organic binders. Regardless of the type of heating apparatus employed, it is rather difficult to heat all individual grains within a sand mass to the same degree in a continuous and uniform manner. When clay-containing sands are being thermally reclaimed, some grains receive just enough heat units to dehydrate, bake, and/or embrittle their "shells". Other grains, at higher temperatures, have their coatings more firmly attached to their surfaces because traces of basic oxides become fluxing agents and promote an incipient fusion of coatings to the grains. This higher temperature may be in part due to carbonaceous materials which are combustible, and create their own heat units. Thus, the destruction of some carbonaceous material may serve to free clay from some grains, but a concentration of heat units also contributes to a firmer adhesion of clay on some other grains. All of this results in some sand grains emerging from thermal reclamation with their clay shells still present, maintaining the influence of enlarged and irregular grain surfaces. Other grains emerge with their coatings susceptible to cracking when they encounter mechanical or thermal forces during subsequent cooling and/or reuse. If the embrittled shell separates from its grain during the preparation of the sand for core binding, such dehydrated particles will be difficult to wet and possess poor adhesiveness with the fresh bond.

While the appearance of a thermally treated sand may be visually pleasing to the eye, because the color is a fresh whitish appearance, this is not indicative of its ability to duplicate the casting performance of new sand. There is evidence to indicate that complete destruction of carbonaceous coatings on individual sand grains contributes little toward satisfactory reuse in either cores or molds. But more importantly, thermal methods may change the electrostatic charge of the reclaim sand so that it never approaches the density and flowability of new sand. This may be due to the discharge of water and thereby hydroxl ions from the sand grains when heating above 1000°, such hydroxl ions normally sharing bonds with $SiO_2$ ions.

Dry Methods

Mechanical methods comprise impacting sand grains to fracture the "shells" of old bonds from individual grains. There are several modes that would fall under the category of being dry, including (a) centrifuging sand against an enclosure; (b) a pneumatically shooting sand against a target, or additionally causing two separate streams of sand to intersect for scrubbing; and (c) mulling at low kinetic energy levels to squeeze the sand grains under pressure of a wheel. The pressure of mulling may crack certain shell segments, but it is almost impossible to treat all grains to a like degree. To be more satisfactory, small batches must be mulled for lengthy periods of time. While mulling removes some segments of the grain coatings, the remaining rough irregular surfaces are just as unsatisfactory as the initial "pickled" surfaces on unmulled grains.

Each of these dry impact modes create new particle fines as a result of fracturing of certain of the sand grains, the amounts varying from 0.1% as a result of pneumatic methods, to as much as 1% by the mulling method. Each of these dry modes suffer some disadvantage, each being unable to separate a significantly high percentage of the shells regardless of the time of use of the apparatus.

Combination Methods

The above has indicated to the foundrymen through the years that each of the different types of reclamation methods provide a separate advantage. For example, organic contaminants respond well to a thermal treatment, whereas soluble contaminants respond well to a wet treatment and insoluble contaminants respond to a dry mechanical treatment. With this in mind, several of the more recent reclamation processes have included certain combinations of these different types. Thermal treatments have been combined with a subsequent wet scrubbing treatment or vice versa; thermal treatments have been combined with dry mechanical treatments (either of the centrifuging type or of the dry scrub type) and in certain instances have additionally been combined with a wet treatment. What these combination processes have failed to appreciate is the economic and governmental regulation deficiencies that are associated with such types and more importantly failed to recognize that different mechanical energy imputs are necessary to obtain a full range of cleaning benefits. Thermal treatments suffer from high energy costs and wet treatments suffer from the serious requirement for extended land usage and inability to meet governmental regulations on disposal of waste sludge, and dry mechanical methods have suffered because of an unsatisfactory product.

Superimposed upon these considerations of economics, legal disposal modes, and technical ability to be reused as a foundry sand, is the technical criteria as to what is a satisfactory reclaimed sand product. Under the old production methods of preparing molding sand and curing of such sand, the criteria for judging successful use of the reclaimed sand was markedly less stringent than today. Today, the requirements, for accepting a reclaimed sand, demand that there be almost no metallics, an absence of organic impurities, an absence of lime, a density equivalent to new sand, a substantial absence of inert friable material (such as dead clay), and a Ph of 7–9. These requirements are impossible to meet with the present state of the art and still meet the Environmental Protection Agency regulations as to disposal, and do so at a reduced energy cost for processing.

SUMMARY OF THE INVENTION

A general object of this invention is to be able to take any type of used dirty sand from a foundry operation and produce a clean sand usable again for core making without the penalties of high thermal energy costs and land disposal problems.

Specifically the invention is to upgrade used foundry sand by a method which is not selective or dependent on the type of contaminants present in the used sand, and by a method which will not be subject to the penalties of high economic costs related to heat energy consumption and not subject to the penalties of governmental regulation related to land usage and disposal of wastes, and which has the capability of producing a product which will cure rapidly in a core making operation equivalent to new lake sand and which will provide a predetermined Ph and low acid demand value indicative of the absence of clay and lime.

A specific object of this invention is to provide an improved method for reclaiming used foundry sand that may contain binder ingredients from both core making and molding and operations, the method being carried out without the expense of employing heat and without the disposal problems associated with wet methods. The resulting product from such improved method is characterized by the substantial absence of fines (0.1% or less), a density of at least 100 grams/biscuit, a biscuit is defined in the AFS Handbook, 1963, a Ph of 7–9, an acid demand value of 15 or less (preferably less than 10) for sand that contains heat converted oxides, and a capability of performing in a core curing operation to provide a strength of at least 300 psi in less than 20 seconds as measured in a hot box core process.

Features pursuant to the above objects comprise: (a) utilizing a totally dry method which in sequence employs a high stress, low kinetic energy cleaning cycle, followed by a high kinetic energy cleaning cycle accompanied by negative pressure for particle separation, (b) carrying out the high stress, low kinetic cycle by use of a sand muller which repeatedly squeezed sand under a high unit pressure of a weighted wheel, and (c) carrying out the high kinetic energy cleaning cycle by use of a pneumatic attrition device which shoots sand grains against a target by way of a high velocity air stream in the presence of a negative air pressure.

DETAILED DESCRIPTION

Spent Foundry-Sand

Figure 1:
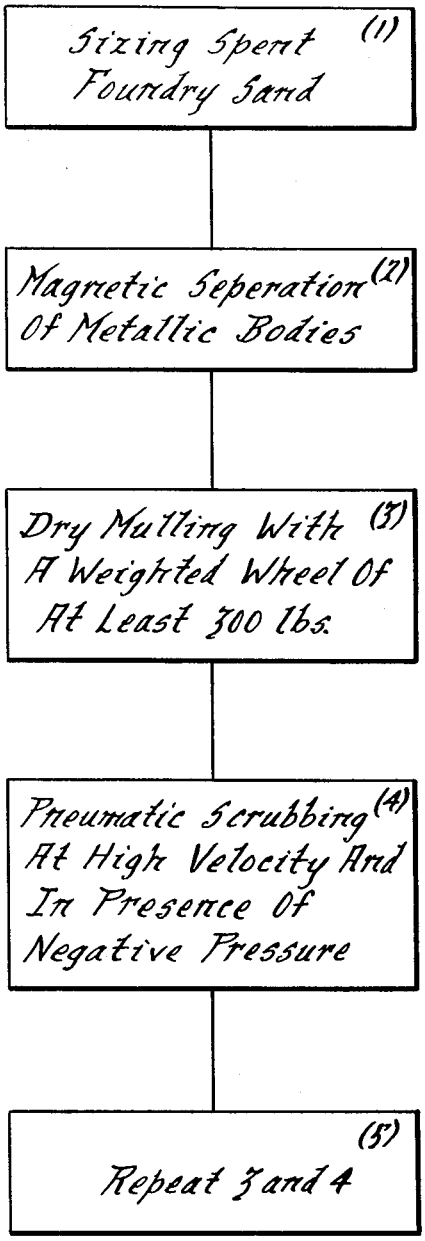
FIG. 1 is a flow diagram of the process steps embodying the present invention.

The origin and use history of spent sand determines its chemical content. A successful reclamation process must be capable of operating with spent sands that have varied origins and varied use histories. The spent sand may be derived from relatively pure new sand or impure below-ground new sand. Below ground sand deposits may contain considerable quantities of lime and magnesium carbonate. These impurities are usually removed by the sand mining operation by way of mineral flotation for the lime and by way of fatty acid techniques for the magnesium carbonate. Since pure natural sand is scarce and costly, new sand will be considered for this invention as typically comprising below ground sand that has been treated as above. Thus, when the natural sand is delivered, it usually contains impurities in the following ranges:

| | | | |
|---|---|---|---|
| $Al_2O_3$ | 5.2% | Alkalies | 1.7% |
| $Fe_2O_3$ | .5 | $SiO_2$ | 90.6 |
| CaO | .7 | Clay | 3–6 |
| MgO | .5 | | |

The impurities in this delivered new sand, of course, become a part of the impurities after the sand is used in the foundry technique. Impurities added to the sand as a result of the foundry practice usually fall into the following classes:

(a) Molding sands contain clay in an amount of 3–6% by volume, powdered coal, alkaline materials such as active lime, and if the sand was employed in a shell molding process, it will contain 1.5–6% phenolics or other organic binding substances. The clay content of such molding sands may consist principally of bentonite which has a high floatability characteristic and is difficult to eliminate from a solution which attempts to dissolve it. Such sand is incapable of being reused in such an impure condition for a core making process. The impurities form a pickled coating on each of the sand grains inhibiting their flowability and bonding characteristics in a new core making process.

(b) Used core sand may contain resins of the cold cure type, such as isocyanates, core oils, cereal binders, core washes, red oxide, or of three general hot box resin types which respond differently to thermal, wet and dry reclaiming techniques. One hot box resin type contains phenolic resins of the class consisting of hexamethylene, tetraamines, or novalac, and contains no clay. This core sand responds well to ignition techniques for elimination of the resins. Another hot box type is that containing phenyl formaldehyde urea. The third type contains furan urea. Each of these different types of hot box resins have a different removal characteristic, some removable more easily than others, i.e. furan urea has a tendency to be removed by scrubbing easier than phenolics. The resin content of the spent sand may range from 5–15%.

For purposes of sand reclamation in this invention, used sand is considered as having some of all of the different additives. This assumption is necessary because most large scale foundries, such as that of the assignee hereof, are core intensive industrial users of sand. This means that new sand is primarily added to the core making area of the foundry and additional sand makeup, for the molding operations, is usually taken from used core sand. Thus, spent sand from the molding operations, which must be reclaimed, contains core making additives and molding sand additives. Moreover, some of the sand is calcined by being burned by the hot metal during casting. Since the total volume of sand will eventually circulate through the different industrial areas of the foundry, it acquires some degree of all of these additives; any successful reclamation process must be capable of removing impurities that are added by either the core making or molding process. Segretation of molding and core sands becomes virtually impossible because in removing the castings from a sand molding, invariably a certain percentage of the cores are broken and drop into the mold to become inadvertently mixed with the molding sand in a quantity that must be recognized.

Figure 2:
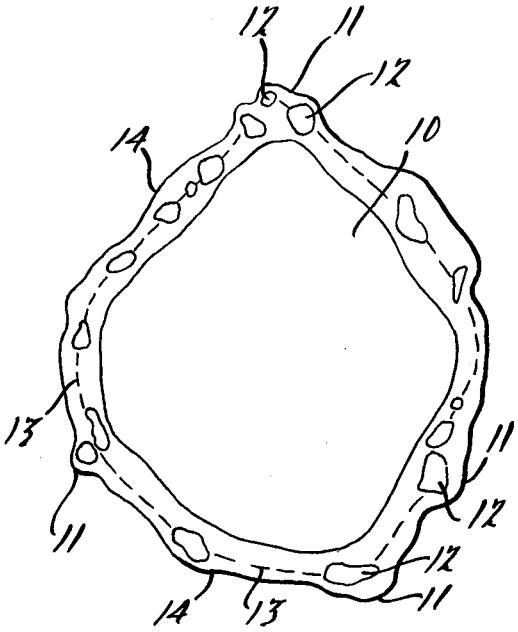
FIG. 2 is an enlarged schematic sectional view of a spent sand grain which is processed by the present invention.

As shown in FIG. 2, spent sand grains 10 are characterized by their surfaces being covered with wart-like projections 11 due to small particles 12 being embedded in the old-bond coatings 13 and 14, which may consist of clay, oils, resins, carbonaceous material or oxides. Such projections 11 not only serve to greatly increase the total surface area of each grain, but by interfering with the movement of one grain past another, the projections decrease flowability and response to ramming energy. When the resistance offered by one or two grains is multiplied by thousands of grains, one comes to understand why old used sands are so difficult to ram into compact uniform mold surfaces.

The size of the grain has a pronounced effect upon the amount of work which a reclaiming system is called upon to do and the degree of cleanliness which the reclaimed product will exhibit. As sand fineness increases, the amount of work necessary to reclaim waste sand increases; as sand shape changes from round to subangular and angular, more effort and energy is required to remove the residual coatings.

Moreover, the exposure of sand to elevated temperatures results in varying linear and volumetric increases in the quartz crystal. Such exposure takes place in molding or core sands during pouring of molten metal. The sand closest to the molten metal receiving the greatest thermal change. This local thermal treatment not only affects resins or clays on the sand grains, but the grain themselves.

Spent or used foundry sand, for which this process has been developed specifically, would typically contain the following constituents: 0–15% by weight of combustible elements (seacoal, cereal binders, core oils, red oxide, hot resins, cold cure resins, etc.); 0–12% clay; 0–3% water moisture; 0–10% metallic elements, resulting from metal spills on scrap metal; minor amounts of foreign matter which may exist as tramp material resulting from careless handling; 5–15% resins from scrap sand cores; the remainder being sand. With respect to the combustible impurities, seacoal usually is comprised of at least 30% volatile combustible matter, at least 50% fixed carbon, 5% maximum ash, 1% maximum sulphur and less than 5% moisture. Bentonite, added as a colloidal clay, contains about 55–62% silica, 15–25% alumina, 3.2–3.7 iron oxide, 1.5–2.3 magnesia, and less than ½% each of calcium oxide, potassium oxide, and sodium oxide. Red iron oxide is added in a finely ground form for retarding core collapsibility and for retarding the effects caused by sand expansion; the red iron oxide usually consists of 82–88% iron oxide, 7–8% silica and 2–3% alumina and some minor amounts of lime, magnesia and alkali. Mold sprays usually consist of carbon powder applied to the mold walls. Core washes usually consist of silica flour modified with a carbon base powder or clay and may have in addition minor amounts of dispersing and wetting agents or binders.

A preferred method sequence for carrying out the invention is illustrated in FIG. 1 and is detailed as follows:

(1) A charge of spent foundry sand is sized to AFS 43–53 utilizing a screening sequence, the sized distribution will be about as follows:

| | |
|---|---|
| 20 mesh | .1 max. |
| 30 mesh | 2.0 max. |
| 40 mesh | 3.0–15.0 |
| 50 mesh | 26.0–40.0 |
| 70 mesh | 35–53.0 |
| 100 mesh | 5.0–15.0 |
| 140 mesh | 4.0 max. |
| 200–270 mesh | .3 max. |

The spent foundry sand will contain a combination of both organic combustible ingredients as well as dead clay (clay that has been subjected to a heating cycle and fails to respond to addition of moisture for maintaining adherency between sand grains). The combustible organic materials will be in the range of 0.5–10% and will typically consist of oils, seacoal, resins of the formaldehyde urea type, furan type or alkyd. The clay content will range between 0.1–12%, a lime content, 0–3% moisture and 0–10% metallic bodies.

(2) Either before or after the sizing step, the spent sand charge is subjected to a magnetic separator whereby tramp metallic bodies are removed and separated.

(3) The sized and magnetically processed sand charge is repeatedly subjected, while under ambient pressure and temperature conditions, and while dry, to a low kinetic energy squeezing action effective to apply a high stress to fragment and burst at least part of the shells on substantially each sand grain in the charge or mixture. The force exerted upon the sand grains should be at least 300 lbs. This squeezing action can be imparted preferably by a mulling device. In a muller, a relatively large body of sand is pressed under pressure received from a mulling wheel which bears down upon the quantity of sand; the sand is continuously plowed so as to be displaced before being resubjected to the squeezing pressure. Mulling should be carried out for a period of 5–30 minutes, depending on the size and force capabilities of the device.

The net yield in processing sand through a muller should be very high, typically close to 100%; that is, for every 1000 pounds of used sand that is processed in a muller, 1000 pounds comes out of the muller for further processing. The quartz crystals, of which the spent sand is comprised, are very hard and do not break down relatively easy as a result of mechanical impacting, as earlier believed by many in the prior art. Mulling does crack "shell" segments from the grain, but it is almost impossible to treat all of the grains to a like degree and most grains will remain with some shell fragments still attached. Fragments of the shells which remain on the grain will provide a rough irregular surface just as unsatisfactory as the initial pickled and unbroken shell surface.

Mulling is very effective in removing live clay which will not come off completely by any other operative mode of sand reclamation. Live clay is defined as that type of clay which will react with water to rebond sand. Spent or dead clay is that which has been affected by heat cycling through a casting procedure whereby high temperatures have affected its ability to respond further to the addition of water. The presence of live clay, of course, is of interest to the foundryman in that its presence is detrimental to core making. Accordingly, if reclaimed foundry sand is to have universal application, it must be free of such live clay.

Mulled sand will contain a heavy proportion of fines, approximately 1% or more. Fines are those particles which are defined to be in a size range below 200 mesh. Fines are not removed by the mulling process because of the low kinetic energy involved which fails to suspend such particles for separation. Fines are unsatisfactory if retained in the reclaimed sands, since they affect proper core making.

Figure 3:
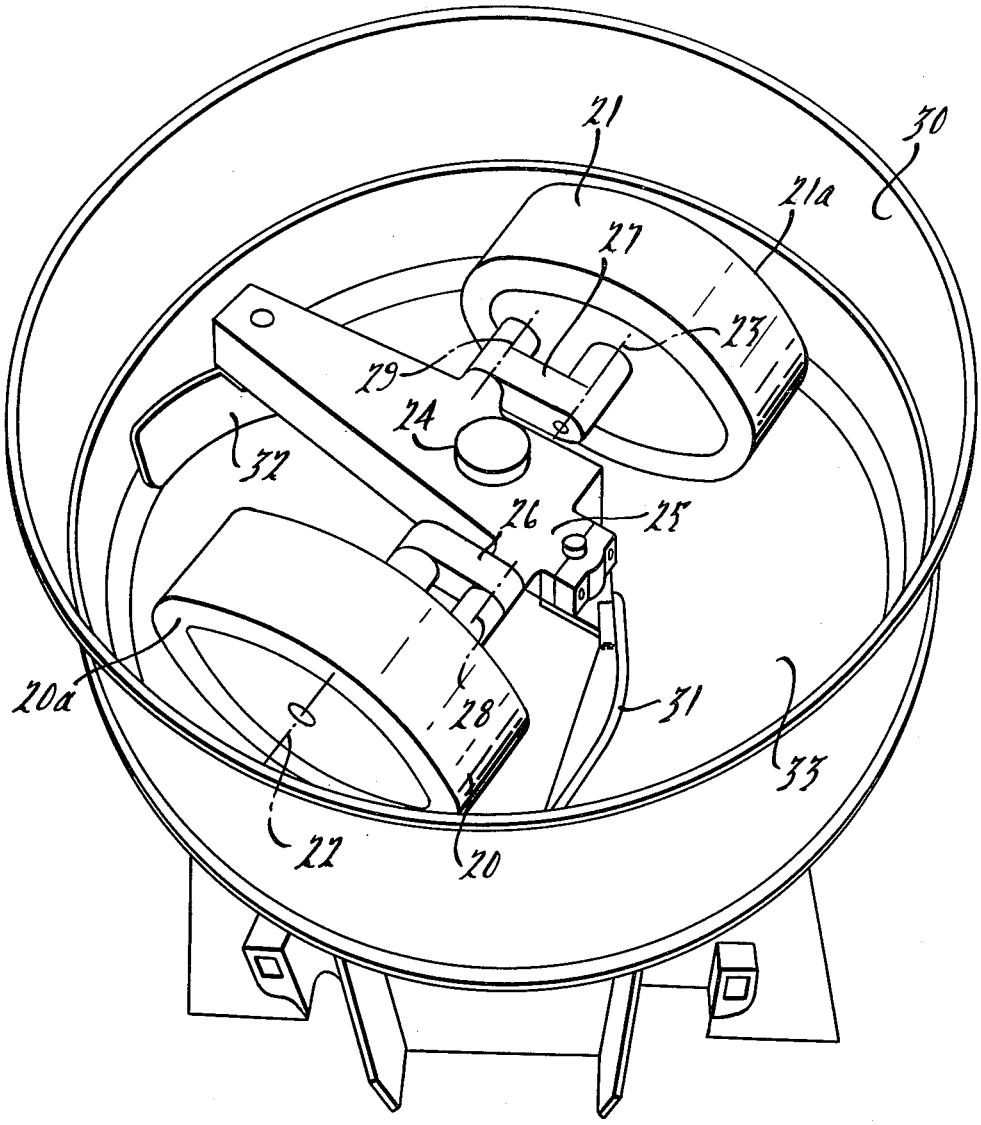
FIG. 3 is a perspective view of a mulling device useful for carrying out the first stage of the process.

Apparatus for carrying out mulling may be of the three general types (a) rapid mulling in which mulling wheels are eccentrically mounted to be urged by centrifugal force against upright side walls, (b) slow speed mulling in which the mulling wheels are held stationery while a crib is rotated to carry plowed sand under the weight of the wheels, and (c) a stationery crib in which hinged mounted mulling wheels are rotated about an offset axis, while being free to rotate about their own wheel axis, to press plowed sand residing beneath the wheels. The mulling device found most useful to carry out the present invention is that shown in FIG. 3. Tandem rollers 20 and 21 are pivotally supported on arms 26 and 27 respectively, which carry spindles 22 and 23 respectively for rotary movement of the wheels about their own central axes. The arms are pivotal about axes 28 and 29 respectively. The axes 28 and 29 are rotated as an assembly by a power rotated post 24 and carriage 25. Each wheel, 20 or 21, should weight at least 300 pounds but not more than 700 pounds. One side of each wheel is located adjacent the crib side wall 30 so that sand build-up along the outer periphery of the base is moved under the wheels. Plows or scrappers 31 and 32 peel up the compacted sand from the floor 33 and reposition the grains for squeezing and kneading along a radius that will encounter the wheels.

(4) The mulled sand is repeatedly subjected, while in the presence of a suction (negative pressure) to a shooting action against a target. The sand is propelled by a stream of air to impart high kinetic energy, the stream delivering between 1,000–10,000 lbs. of sand through a discharge opening having a diameter between 0.6–2 inches, whereby the remaining fragments of said shells are dislodged and any particles finer than 200 mesh are separated by said suction.

Figure 4:
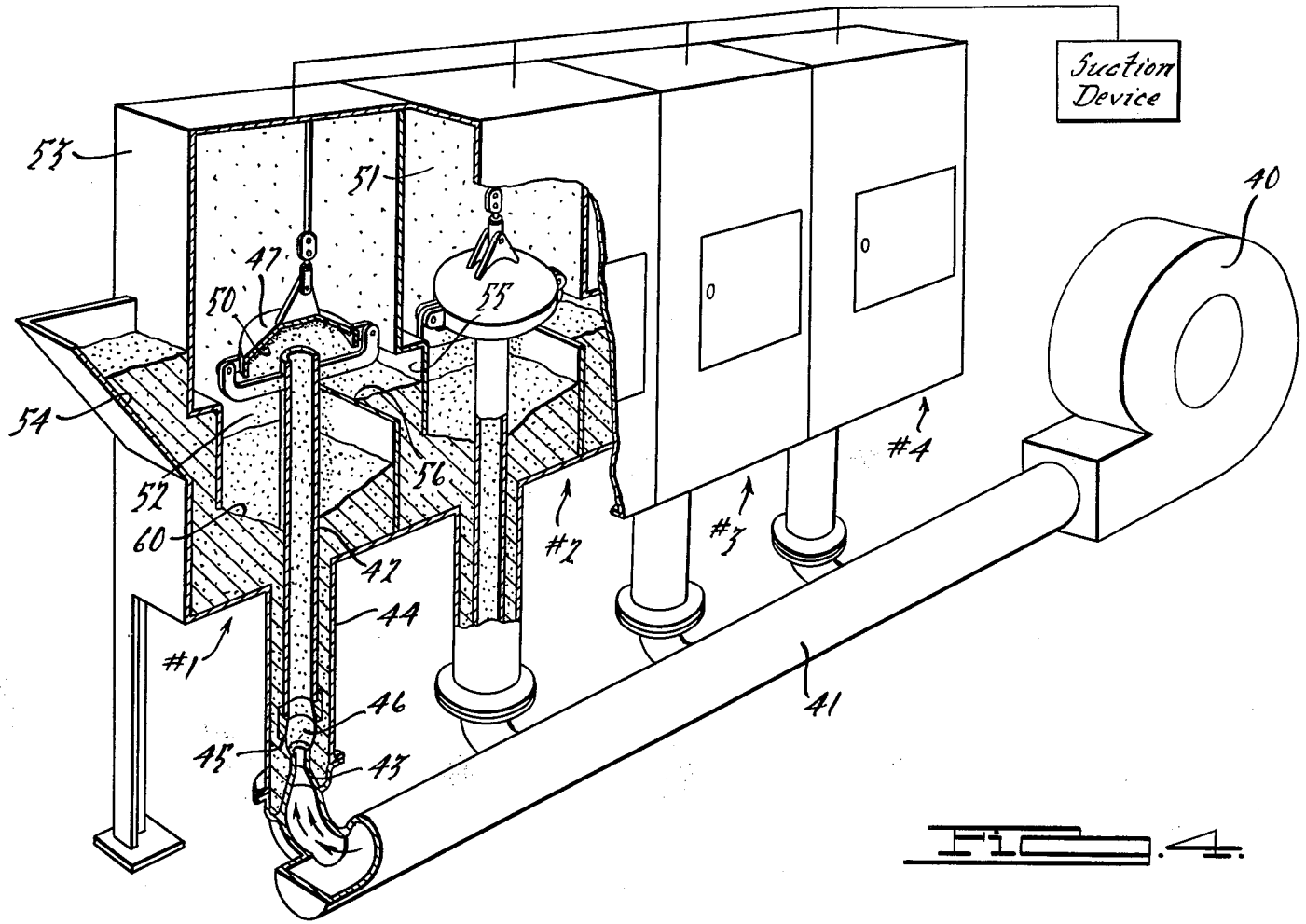
FIG. 4 is a perspective view, partly broken away, of a pneumatic attrition device useful for carrying out the second stage of the process.

This step can be carried out by a pneumatic attrition device as shown in FIG. 4. Essentially, it consists of an air delivery system (40–41), a containing shell 44, an air nozzle 43, a bottom flared (45) center pipe or tube 42, a conical target 47, an expansion chamber 53, and an exhaust duct.

In operation, the unit is charged with a batch of used sand at 54. Air from a positive-pressure type blower 41 is introduced through the high-velocity nozzle 43.

The elongated portion of the containing shall 44 surrounding the center-pipe 42 (which has been termed the "well") is so designed for a purpose. By concentrating the weight of the charged sand on a small horizontal area, sufficient vertical "sand-pressure" is developed to overcome the static pressure of the air stream after it leaves the nozzle 43 and before it enters the center-pipe. This "sand-pressure" confines the air-stream to passing upward through the center-pipe, and prevents "blow-backs" along the exterior of the center-pipe and upward through the "well". The "sand-pressure" also forces sand into the high-velocity air stream, and ensures a consistent loading of the stream at a maximum rate.

As sand is forced into the space 46 between nozzle and center-pipe, it becomes entrained in the air stream, and is hurled upward through the pipe. It emerges at the top of the pipe with considerable velocity and collides with sand 50 trapped in the peak of the conical target 47.

The conical target possesses the ability to hold an ever-changing, yet more-or-less constant, mass of sand within its peak. The mass is held in position by the upward force of the sand/air mixture emerging from the center-pipe. Sand grains continuously escape from around the circumference of the conical mass while new grains are being added to its center. The net result is that most of the metal target is continuously covered with a layer of sand; and sand grains impinge upon sand grains - not sand grains against metal.

After emerging from the center pipe and colliding with the sand mass 50 trapped in the target peak, the sand/air mixture is deflected outward and downward by the skirts of this target cone. The sand separates from the air and returns by gravity to the main sand mass lying in the bottom of the containing shell. The air flows outward and upward around the edges of the target and escapes from the shell via the exhaust ducts in the upper walls. The enlarged upper portion 53 of the containing shell serves as an expansion chamber, the mixture being permitted to suddenly expand after emerging from the center pipe/target cone area. The high velocity air stream is converted to slow moving air currents which rises outside of the cone. Such currents are unable to retain most sand grains in suspension; however, particles 51 of fragmented bond and silica that are of a fine size, are air floated to remain in suspension and be carried out of the containing shell with the escaping exhaust gas.

In each cell the sand is deflected by the conical target 47 and piled up along the exterior walls 44 of the cell; the sand then flows inward and downward into the well surrounding the cell center pipe. Flow in this manner creates a steeply slopping upper sand surface 60 in the shape of an inverted cone or vortex, in each cell. Because of this natural feature, baffles are not needed in the cells to prevent sand grains moving directly from inlet opening 54 to outlet opening 55. As sand grains enter and fall into the vortex in a cell, they must be cycled one or more times in that cell before target deflection places them in position to escape through the opening 55 to the next cell. While the conical target is deflecting sand from all points on its circumference and the deflected sand is piling up along all of the exterior walls of the cells, only the sand grains that fall immediately onto the shelf 56 in front of the limited opening 55 escape to the next cell during any one cycle. The sand grains that do not escape must, of necessity, continue to recycle until they are fortunate enough to fall in front of the opening.

It is important to carry out the high kinetic energy impacting for a period sufficient to cleanse each particle. The yield from pneumatic dry scrubbing can be about 95% if a 4000 lb./hr. delivery tube is employed. The yield drops somewhat as the capacity of the device is lowered. The quality of sand affects the scrubbing period to some degree. For more severe applications such as coarse sands, it may be required to carry out the dry scrubbing for as long as 45 minutes per batch.

The construction of a continuous pneumatic reclaiming unit would comprise several batch units combined in each sequence to provide at least four units or cells using a common expansion chamber 53, exhaust and intake systems 41. Through a receiving tank and the manifold 41, a single blower 40 supplies air to all the cells 1, 2, 3 and 4. In each four cell sequence, continuous flow is achieved by connecting the cells together in a step like fashion. Openings permit sand to flow from feed hopper 54 to cell #1, cell #2, cell #3, and cell #4 to discharge. Sand flowing from feed hopper into the #1 cell raises its level beyond a set height and it is forced to overflow into the #2 cell. #2 cell in turn is forced to overflow into #3 and #3 into #4 and #4 into the discharge unit.

The mulled and scrubbed sand is then subjected to classification to separate the burst shells from the sand grains and to size the sand grains. This may be carried out by conventional series of sieves or by air separation in a cyclone chamber.

We claim:

1. A method of conditioning a spent foundry sand mixture, said mixture containing 0.1–12% clay, said clay forming a shell on the grains of said mixture, the method comprising:

(a) while under ambient pressure and temperature conditions and without the addition of water, subjecting said mixture to a high-stress, low-kinetic energy squeezing action effective to slowly rub the mixture grains against each other and to fragment at least part of the shells on substantially each sand grain in said mixture, (b) while in the presence of a negative pressure or suction, propelling said squeezed mixture grains against a target and/or against each other in a high-kinetic energy stream, the sand mixture in said stream having flow rate of 1000–10,000 pounds per hour through a discharge opening having a diameter of 0.6–2 inches, whereby the remaining fragments of said shells on said mixture grains are dislodged and many particles finer than 200 mesh are separated by said suction, and (c) subject said mixture of burst shells and sand grains to classification for separation.

2. The method as in claim 1, in which said clay in said sand mixture is comprised of bentonite or natural clay.

3. The method as in claim 1, in which the sand grains are comprised of quartz crystals.

4. The method as in claim 1, in which step (a) said sand grains are propelled by an airflow having a velocity of at least 600 cfm, at a pressure of about 150 mm. of Hg.

5. The method as in claim 1, in which step (a) is carried out by use of a mulling machine having a pan, a mulling wheel and a plow effective to repeatedly impart a squeezing force to said sand mixture directed beneath said wheel, said wheel having a weight of at least 300 lbs.

6. The method as in claim 1, in which step (b) is carried out by use of a pneumatic attrition scrubbing device.

7. A method of conditioning a used foundry sand mixture, said mixture containing at lease one or more elements selected from the group consisting of 0.1–12% clay, 0.5–10% combustible organic material, and lime, said selected elements forming a shell on the grains of said mixture, the method comprising: performing in sequence a mulling of said sand mixture for a period of time of about 6–30 minutes and then pneumatically scrubbing said mixture employing a flow rate of 1000–10,000 pounds/hr. through a discharge opening having a diameter of 0.6–2 inches, repeating said mulling and scrubbing sequence until the said mixture has a Ph factor of 6–9, substantially zero percent clay content, substantially zero percent organic combustible content, and 0.1% or less particle fines, and exhibits a density of at least 100 grams/biscuit when compacted.

8. The method as in claim 7, in which the resulting product is mixed with 50% natural new sand to form a composite for use in core making.

* * * * *